US005426619A

United States Patent [19]

Madden et al.

[11] Patent Number: 5,426,619

[45] Date of Patent: Jun. 20, 1995

[54] MATCHED ARRAY PLATE

[75] Inventors: Peter E. Madden, Shaker Heights; Paul N. Turner, Concord Township, Lake County; Daniel N. Kosareo, Lyndhurst, all of Ohio; John Zaldonis, Export, Pa.

[73] Assignee: Westinghouse Electric Corporation, Pittsburgh, Pa.

[21] Appl. No.: 264,128

[22] Filed: Jun. 21, 1994

[51] Int. Cl.[6] ..... H04R 23/00

[52] U.S. Cl. ..... 367/153; 367/165; 367/173; 367/176; 367/901; 310/337; 181/104; 114/21.3

[58] Field of Search ..... 367/153, 155, 162, 165, 367/173, 176, 901; 310/337; 181/140; 114/21.3

[56] References Cited

U.S. PATENT DOCUMENTS 3,492,634 1/1970 Massa ..... 367/153
4,158,189 6/1979 Wardle ..... 367/153
4,192,246 3/1980 Hodges et al. ..... 114/23
4,380,808 4/1983 Hill et al. ..... 367/153
4,463,454 7/1984 Hemond et al. ..... 367/173
4,982,385 1/1991 Eynck ..... 367/151
5,243,566 9/1993 Anderson ..... 367/153

*Primary Examiner*—J. Woodrow Eldred

[57] ABSTRACT

An array plate for use in an underwater craft. The craft having an array of sonar elements which has a selected range of operating frequencies. The array plate having at least one layer of material in which the layer(s) of material are designed to have selected natural frequencies of vibration throughout the range of sonar operating frequencies. The natural frequencies resulting in standing waves having selected wavelengths that develop along the layer(s) of material. The sonar elements are mounted upon the layer(s) of material such that adjacent sonar elements are spaced apart a distance of one half the average wavelength of the standing waves.

7 Claims, 3 Drawing Sheets

MATCHED ARRAY PLATE

BACKGROUND OF THE INVENTION

1. Field of the Invention

This invention relates generally with reducing self noise in sonar systems. More particularly, the invention relates to reducing self noise from sonar operational vibrations in underwater acoustic systems.

2. Description of the Prior Art

The term "self noise" as used with sonar arrays describes the noise in the output signal of the array due to vibrations in the sonar array structure or the platform upon which the array is mounted. The sonar array is comprised of multiple sonar elements. Each sonar element is connected to an array mounting plate by an isolation mount. The isolation mount is a spring-like device, typically fabricated from a cylindrical section of a somewhat flexible material.

Low self noise is desirable because it enables the sonar to detect low level incoming signals. This in turn increases the acquisition range for a specified target. Assuming all electrical sources of self noise have been eliminated or minimized, mechanical sources are the next sources to consider.

For underwater vehicles, an acoustic array is typically mounted on the front or nose of the craft. As the craft moves through the water, the water flow travels around the nose and at some point along the shell of the craft, the water flow turns from laminar to turbulent. The vibrations due to this transition are a source of noise whereby energy from the turbulence is transferred through the nose structure to the array, exciting the array elements through two paths. The first path is through the tip of the nose into the fluid and enters the elements via their pressure response. The second path is through the array mounting plate and each element's isolation mount.

Experiments indicate the dominant path that the vibrational energy follows (i.e., through the water or through the array mounting) depends on the type of sonar beam that is formed. For beams formed from a single or from a few elements, the water path is usually dominant. For beams formed from many elements, the path through the array plate and element isolation mount is dominant. However, regardless of which path provides significant reducing vibration of the array plate provides significant additional self noise reductions for both single elements and multi-element beams.

Several methods have been proposed in the industry for reducing self noise. One technique is to design the contour of the nose shell to delay the onset of turbulent flow to a point substantially downstream from the nose. This moves the source of vibration further back along the shell away from the array.

Another technique is to design the shell with large impedance mismatches which reduce the transmission down the shell. Sonar array windows that wrap around the nose shell can provide some damping of vibrations in the shell as can damping material applied directly to the inside of the shell. Shells made of composite construction have also been tested. Array element mounting techniques that reduce the vibration transmitted through the element mounts are the standard way of reducing sonar self noise. Array plate assemblies are sometimes manufactured with a septum and viscoelastic layer which provides constrained layer damping. The array elements are then mounted on this septum.

Self noise reduction (SNORE) rods have been tested in the industry to reduce the defraction of sound around the torpedo nose shell.

The industry has attempted to address the self noise problem in underwater sonar devices, however, such attempts have not been entirely successful. There remains, therefore, a need for a method or device which will effectively reduce the self noise of underwater sonar devices.

SUMMARY OF THE INVENTION

We provide a wave speed matched array plate for use with underwater vehicles that will reduce self noise in the sonar array system. The underwater craft has a sonar system with a plurality of sonar elements arranged in an array. The sonar elements are mounted on a mounting plate. The sonar elements (which are piezoelectric devices) detect sound energy and transform that sound into an electrical output voltage. The sonar system of the craft operates in a selected frequency bandwidth which can be affected by unwanted vibrational noise generated by the moving vehicle. This unwanted vibrational energy is transmitted to the sonar elements through the fluid path and the nose structure. This unwanted vibrational energy raises the background noise level of the electrical signal which decreases the sonar's ability to detect a target.

The matched array plate comprises at least one layer of material forming a structure having selected natural frequencies in the operating frequency range of the sonar array. The natural frequencies of the array plate have respective wave forms and, therefore, have respective wavelengths. The sonar elements are mounted upon the matched array plate such that adjacent sonar elements have a spacing of $\lambda/2$. $\lambda$ is the average wavelength associated with a particular natural frequency that exists in the matched array plate in the operating frequency range of the sonar array. The array plate thereby reduces self noise (via this structural mechanism) from energy that enters the array through the vibration response of the element.

Other objects and advantages of the invention will become apparent from a description of certain present preferred embodiments thereof shown in the drawings.

DETAILED DESCRIPTION OF THE PREFERRED EMBODIMENT

Figure 1:
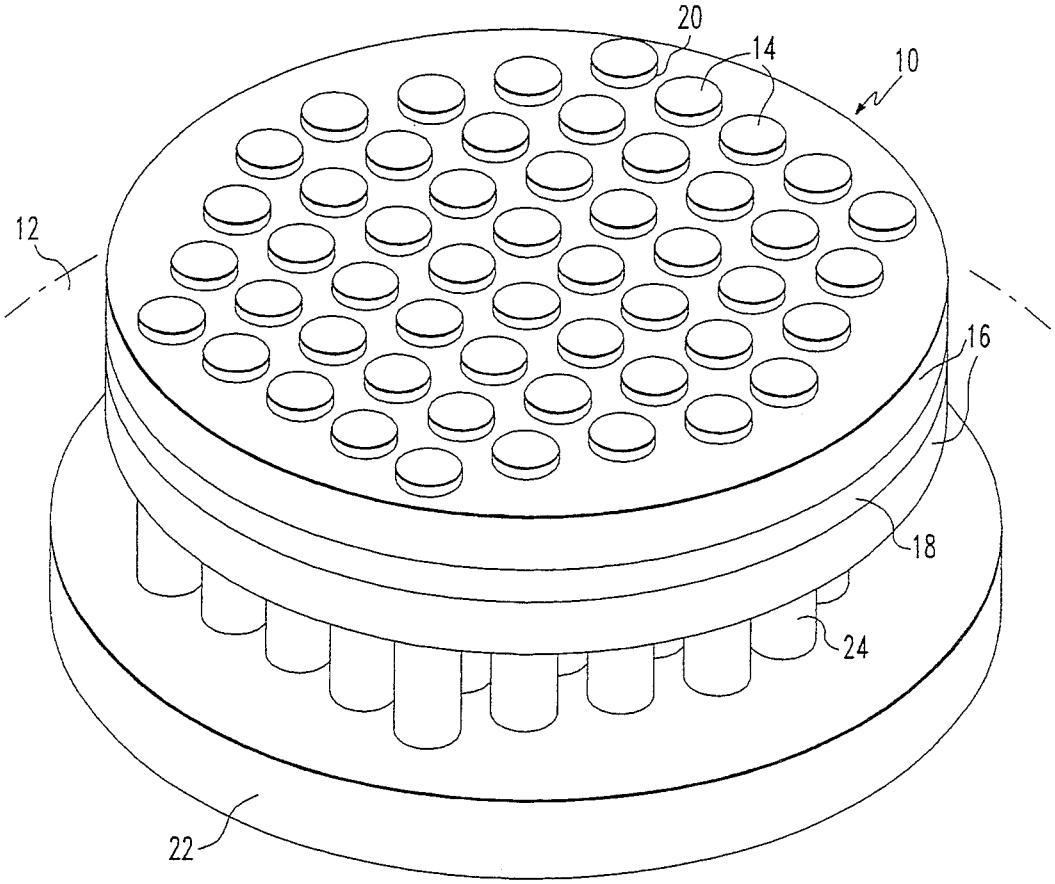
FIG. 1 is a perspective view of the preferred matched array plate system.

A wave speed matched array mounting plate 10 is shown in FIG. 1 for use with underwater crafts (depicted as dotted line 12). The underwater craft 12 has a sonar system with a plurality of sonar elements 14 arranged in an array configuration in the nose shell of the craft. The sonar elements 14 are mounted on the array mounting plate 10 which is affixed to the nose shell. The array plate 10 is constructed so as to exhibit selected characteristics when subjected to vibratory excitation.

This wave speed matched array plate 10 is preferably comprised of two sections or layers of a strong, rigid material 16, such as stainless steel, with a layer of a damping material 18 sandwiched therebetween. The preferred array plate 10 utilizes disc-shaped, 12.04 inch diameter, 0.71 inch thick stainless steel as the rigid layers 16. However, aluminum or other material that is sufficiently rigid and has the appropriate thickness may be used as the rigid layers 16. The damping material layer 18 is preferably fabricated of a viscoelastic polymer identified as UDRI-2, which is produced by the University of Dayton Research institute. The circular viscoelastic damping layer 18 is also preferably 12.04 inches in diameter and 0.005 inches thick.

Laboratory measurements have shown a system damping loss factor of approximately 0.2 at operating frequencies. The sonar element transducers 14 are attached to the matched array plate 10 in the conventional manner in which a hole or bore 20 is provided through the array plate 10 at each location in which a sonar element 14 is to be mounted. The size, number and spacing of the element bores 20 contribute to the vibration characteristics of the array plate 10. Preferably, the array plate 10 has fifty-two (52) element bores 20 provided therethrough, each element bore 20 having a diameter of 1.08 inches and being spaced 1.40 inches apart. Although the number of elements (and element bores) used is preferably fifty-two (52), any number may be used that is suitable for the sonar application.

To satisfy structural requirements due to operational loads, the wave speed matched plate 10 is preferably attached to a steel strongback 22. The strongback 22 is made of a strong, rigid material, such as stainless steel. The preferred strongback 22 is 1.10 inches thick and is 14 inches in diameter. Tubes of compliant material 24 are positioned between the array plate 10 and the strongback 22 to decouple vibrations in the strongback 22 from the matched array plate 10. Syntactic foam is the preferred material for the compliant tubes 24 because it meets all structural and vibrational requirements for underwater craft, sonar applications.

The underwater craft 12 employs its sonar throughout a selected range of frequencies. The turbulent boundary layers and machinery noise causes vibrational excitation of the array plate 10. Standing waves develop along the array plate 10, in which a number of standing waves (having different mode shapes and wavelengths $\lambda$) develop at various sonar operating frequencies.

The number of standing waves that are developed at various frequencies, as well as the mode shapes of the standing waves, may be selected by varying the design of the array plate 10. The design characteristics of the array plate 10 which may be varied to obtain different mode shapes include the thickness, diameter and type of material used for the rigid plates 16, the damping layer 18 as well as the overall thickness and diameter of the array plate 10. The number, size and spacing of the element bores 20 will also affect the mode shapes of the array plate 10. Mechanical and acoustic vibrations are a source of noise whereby energy from the turbulent boundary layer and machinery is transferred through the structure of the sonar array, exciting the sonar array elements. For the operational frequency bandwidth, the effective wave speed of the vibrational energy in the array plate 10 has been designed to be approximately equal to the velocity of sound in water.

The present preferred array mounting plate 10 is fabricated such that the effective wave speech of the energy carrying modes in the plate and the spacing of the sonar array elements 14 result in array elements 14 that have a preferred spacing. The preferred element spacing is approximately one half of the average wavelength ($\lambda/2$) for the standing waves (mode shapes) developed on the array plate 10 for the operating frequency bandwidth.

Figure 2:
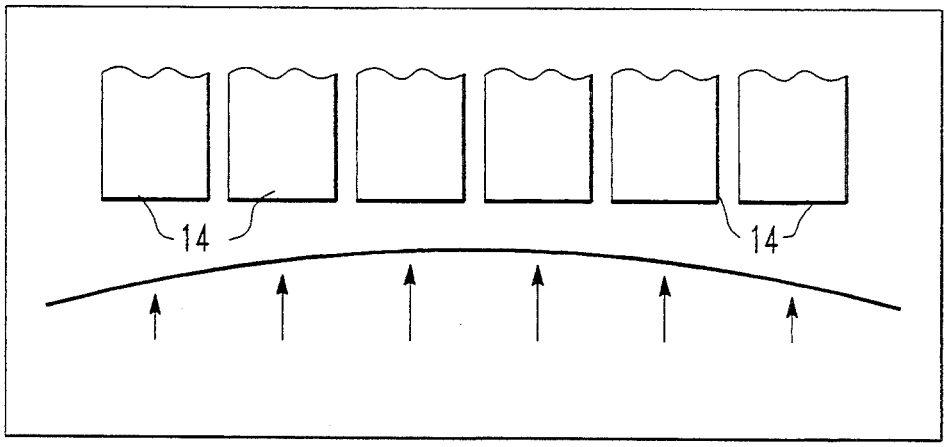
FIG. 2 is a schematic representation of a line of elements such that the output of the elements whose spacing is much less than the wavelength of the unwanted vibration signals are in phase.

The one-half wavelength spacing of the sonar elements 14 accomplishes noise reduction as follows with reference to FIGS. 2 and 3. The matched array plate 10 minimizes the sum beams formed by adding together the outputs of the sonar array elements 14 by taking advantage of the coherent nature of the signal processing. FIG. 2 is a representation of a line of sonar elements 14 in a sonar array being excited by vibrations in the array plate 10. The vectors (depicted as arrows in the figure) represent the phase of the electrical signal from each sonar element 14. For a line of elements 14 that are closely spaced compared to the wavelength of the vibration excitation, the electrical signals are in phase (the vectors point in the same direction). Adding the individual voltage outputs gives a large total array voltage output since the vectors all point in the same direction and the voltages add constructively.

Figure 3:
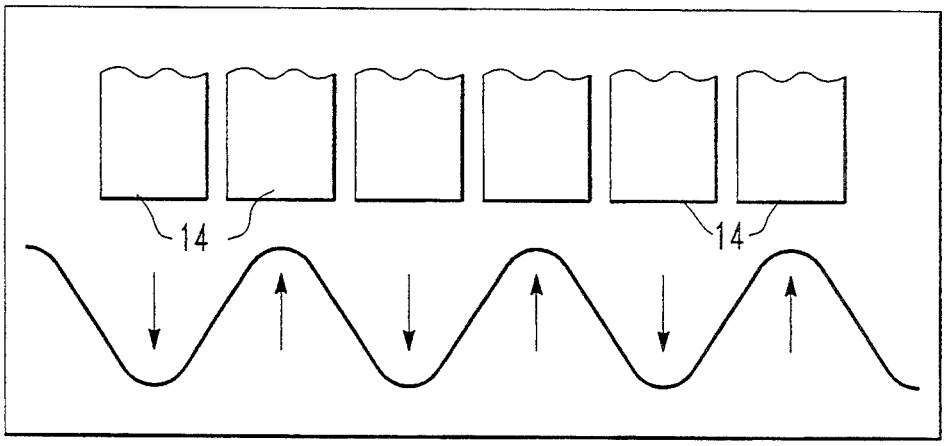
FIG. 3 is a view similar to FIG. 2 in which the sonar element spacing is equal to half the wavelength of the unwanted vibration such that the element output signals are out of phase.

Referring next to FIG. 3, the same line of sonar elements 14 as shown in FIG. 2 is depicted whose interelement spacing is now equal to one half the average wavelength of the standing waves due to vibration excitation. The electrical signals of the adjacent sonar elements 14 are now out of phase (the vectors point in opposite directions). Adding the individual voltage outputs gives a reduction in the total array output voltage since the individual voltages add together destructively and cancel each other out. To the extent that the sonar elements 14 are 180° out of phase, the voltages will add to zero.

Since the voltage outputs from the array elements 14 are added together coherently, they add together out of phase in the matched array plate design. The out of phase addition of the voltage outputs (sum beams) reduces the contribution from the turbulent boundary and machinery noise which results in a greatly reduced overall random noise level. This occurs even though the vibrational energy reaching the sonar elements 14 is not reduced as it is in other approaches.

The steel strongback 22 is designed to be sufficiently stiff to meet maximum deflection specifications under hydrostatic pressure loads. The preferred stiffness of the steel strongback 22 is $2.3\times10^6$ lb/in. Furthermore, the mounting plate 10 is damped so that high frequency resonances in the sonar operating frequencies are reduced by 20 to 30 dB.

Figure 4A:
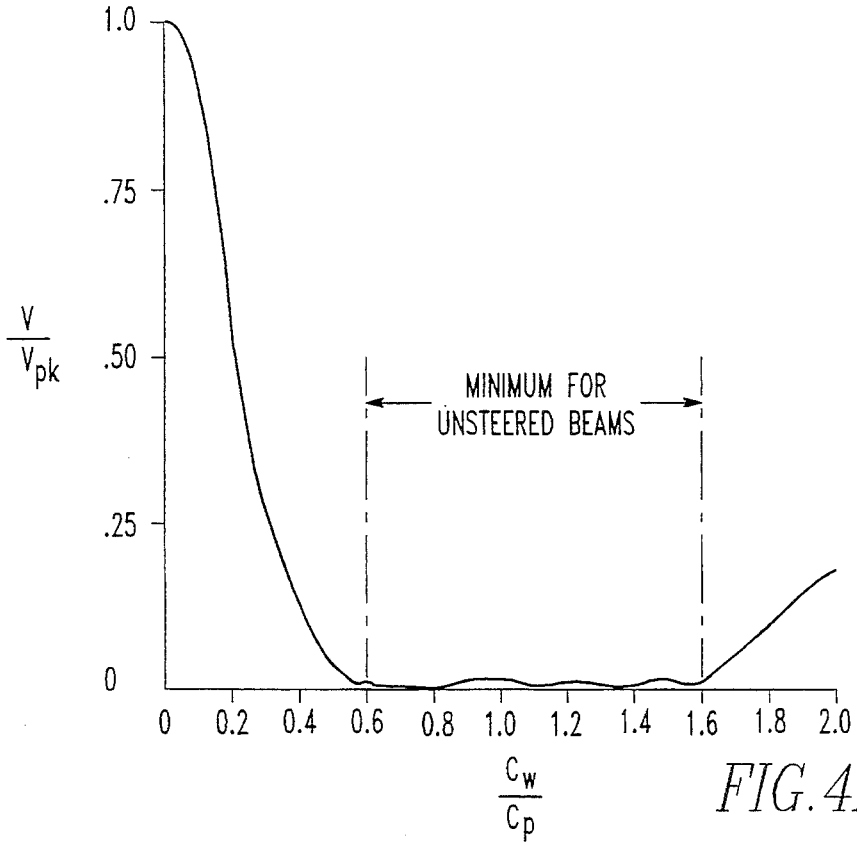
FIG. 4A is a plot of the predicted output voltage normalized to the peak output voltage as a function of the ratio of the wave speed in water to the wave speed of the energy carrying modes of an array plate for unsteered beams.
Figure 4B:
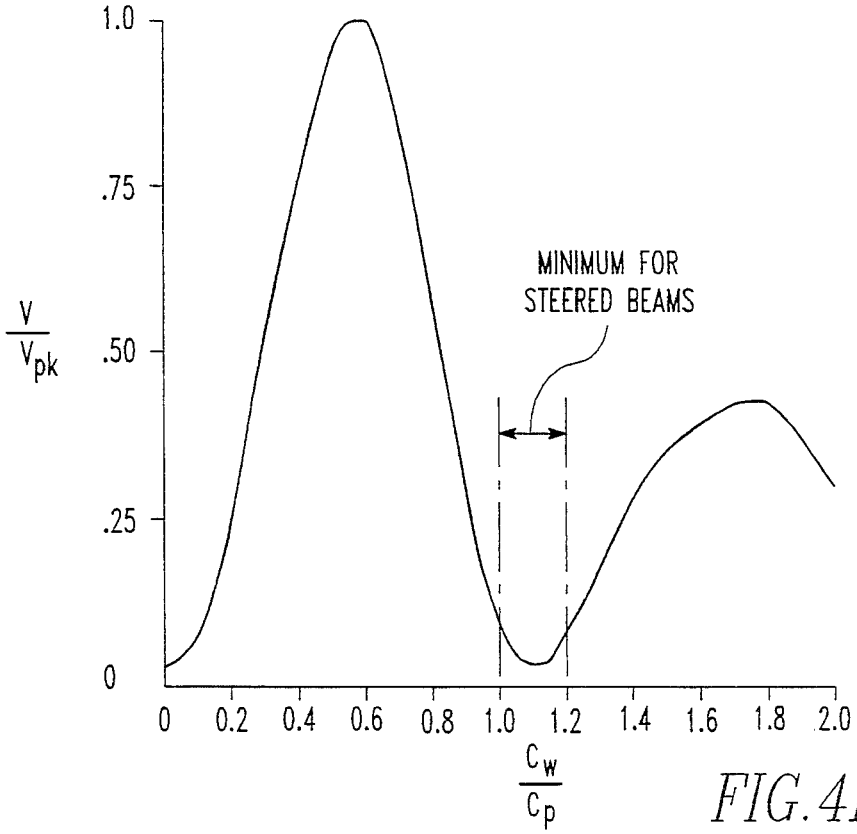
FIG. 4B is a plot similar to FIG. 4A for steered beams.

FIG. 4A depicts the predicted output voltage, V, normalized to the peak output voltage, $V_{pk}$, as a function of the ratio of the wave speed in water to the wave speed of the energy carrying modes in the array plate 10, $C_w/C_p$ for unsteered beams. The array response is plotted for a sonar array having elements 14 whose spacing is one half of the wavelength of sound in the sonar frequency range of interest. For unsteered beams, a wide range of wave speed ratios ($0.5<C_w/C_p<1.6$) gives the minimum output voltage. However, for steered beams as shown in FIG. 4B, the minimum output voltage occurs within a narrow range ($1.0<C_w/C_p<1.2$). Therefore, for all beams, the wave speed of the energy carrying modes should be about 1350 meters per second ($C_w/C_p=1.1$) or very nearly the wave speed of sound in water. The wave speed of the energy carrying modes is designed to be approximately the wave speed of sound in water by varying the design characteristics of the array plate 10 (thickness, diameter, material, damping layer 18, and the number, size and spacing of the element bores 20) as previously described. A computer simulation was performed in optimizing these design characteristics. For this simulation, a finite element model of the matched array plate was created. Keeping the material properties and planar geometry constant, the thickness of the wave matched plate was varied until an optimum thickness was determined. The matched array plate with the optimal thickness has a wavespeed that is equivalent to the wavespeed in water in the frequency range of interest.

The voltage response of the array (the y axis along the side of the plot of FIGS. 4A and 4B) is dependent on the velocity of sound in the plate. At the far left of the plot of FIG. 4A, the energy carrying waves are moving very quickly and with a very long wavelength, and are adding up in phase producing a large voltage output. As the waves get slower, the waves tend to cancel one another out and a region is formed in which the output voltage reaches a minimum for an unsteered beam. In that region the wave speed in the plate is matched to the speed of the waves which are travelling through the water.

An energy wave (which can be considered a sum of sine waves) travels through the matched array plate 10 upon which a number of sonar elements 14 are mounted. The mounting plate is designed to provide mode shapes in the mounting plate 10 such that alternate sonar elements 14 sit on the peaks and the troughs of a particular wave. By placing alternate sonar elements 14 on the peaks and troughs of the energy wave, the vibrational induced noise occurring at each sonar element 14 tends to cancel one another.

The preferred matched array plate 10 is thus designed so that the wavelength of the energy carrying modes of vibration in the plate is such that the sonar elements are spaced one half wavelength apart in the frequency range of the sonar band. The matched array plate 10 utilizes sonar element spacing in the array that is one half the wavelength of the wave speed of sound in water at the center frequency of the sonar frequency band of operation. Thus, the array plate 10 is designed to match the wave speed of the energy carrying modes in the array plate with the wave speed of sound in water.

Although particular materials and dimensions have been provided for the description of the preferred array plate 10, it is distinctly understood that different material, dimensions, number of layers, etc. will result in various mode shapes (standing wave patterns) in the array plate 10. Whichever mode is developed along the array plate 10, the sonar elements 14 will be spaced apart a distance of one-half the average wavelength of the mode.

Furthermore, although a multilayer array plate 10 is preferred, the array plate may instead be comprised of one, two or any number of layers wherein the layers have selected stiffness/compliance and dimensions.

while certain present preferred embodiments have been shown and described, it is distinctly understood that the invention is not limited thereto but may be otherwise embodied within the scope of the following claims.

We claim:

1. An array plate for use in a craft, the craft having an array of sonar elements, wherein the sonar array has a selected range of operating frequencies, the array plate comprising:

at least one layer of material connected to the craft; and means for providing the at least one layer of material with selected natural frequencies of vibration throughout the range of sonar operating frequencies, such that standing waves having selected wavelengths develop along the at least one layer of material;

wherein the sonar elements are mounted upon the at least one layer of material such that adjacent sonar elements are spaced apart a distance of one half an average wavelength of the standing waves.

2. The array plate of claim 1 wherein the means for providing the at least one layer of material with the selected natural frequencies comprises providing each at least one layer of material with selected dimensions, selected mass and selected stiffness.

3. The array plate of claim 2 wherein the at least one layer of material comprises a layer of viscoelastic material provided between two layers of a material that is rigid compared to the viscoelastic material.

4. The array plate of claim 3 wherein the rigid layers are fabricated of at least one of carbon steel, stainless steel, aluminum and titanium.

5. The array plate of claim 4 wherein the rigid layers are between 0.705 and 0.715 inches in thickness.

6. The array plate of claim 3 wherein the viscoelastic layers is fabricated of butyl-rubber.

7. The array plate of claim 3 wherein the layer of viscoelastic material is between 3 and 10 thousandths of an inch in thickness.

* * * * *